United States Patent [19]

Silber

[11] Patent Number: 5,076,724

[45] Date of Patent: Dec. 31, 1991

[54] STRUCTURAL CONNECTOR

[76] Inventor: Meir Silber, 755 York Mills Rd., Suite 507, Don Mills, Ontario M3B 1X4, Canada

[21] Appl. No.: 429,479

[22] Filed: Oct. 31, 1989

[30] Foreign Application Priority Data

Nov. 21, 1988 [IL] Israel ..... 088436

[51] Int. Cl.[5] ..... F16D 1/00

[52] U.S. Cl. ..... 403/171; 403/176; 403/217; 52/648

[58] Field of Search ..... 403/170–176, 403/177, 178, 408.1, 257, 217; 52/648, 646, 645

[56] References Cited

U.S. PATENT DOCUMENTS

| | | | |
|---|---|---|---|
| 2,212,455 | 8/1940 | Reed | 403/170 X |
| 2,954,250 | 9/1960 | Wing | 403/171 X |
| 3,507,526 | 4/1970 | Packman et al. | 403/173 |
| 3,864,051 | 2/1975 | Reid | 403/171 X |
| 4,676,043 | 6/1987 | Grimm | 403/171 X |
| 4,822,199 | 4/1989 | Nehls | 403/171 |
| 4,863,303 | 9/1989 | Croucher, Jr. et al. | 403/171 X |
| 4,982,841 | 9/1976 | Endzweig | 403/171 X |

FOREIGN PATENT DOCUMENTS

| | | | |
|---|---|---|---|
| 566256 | 4/1958 | France | 403/170 |
| 798278 | 7/1958 | United Kingdom | 403/170 |

*Primary Examiner*—Andrew V. Kundrat
*Attorney, Agent, or Firm*—Benjamin J. Barish

[57] ABSTRACT

This invention relates to a connector for the elongated elements of a structural space frame, and to a space frame employing the connectors. The connector consists of a base element and up to two elongate connector members. The base element includes both first and second bores lying along first and second axes, and first and second pairs of parallel faces intersecting with the first and second axes respectively at right-angles. The first and second elongate connector members are housed within the first and second bores of the base element, and each connector member includes outwardly extending threaded portions at both ends, the threaded portions being parallel screw threads. The threaded portions respectively engage adjacent primary elongated frame elements, by means of tightening these elements in opposite axial directions against the base element. The first and second axes are arranged in substantially parallel planes, spaced apart by substantially the diameter of a single elongate connector member. The connector base element also comprises apparatus for supporting a plurality of diagonal frame elements lying along axes intersecting at the connector with the substantially parallel planes.

16 Claims, 3 Drawing Sheets

STRUCTURAL CONNECTOR

FIELD OF THE INVENTION

The present invention relates generally to structural connectors and, particularly, to connecting elements for space frames.

BACKGROUND OF THE INVENTION

In the field of space frames, such as may be used to support roofs over a large span, of vital importance is the strength of elements used to connect between a number of structural elements at a point in space and the way in which the connection is made. The most common geometrical configuration of space frames is the double layer, square module frame, utilizing a single type of connectors. Such a typical connector is designed to connect eight frame elements, the first four of which are substantially coplanar, and the second four are inclined relatively to and on the same side of the plane defined by the first four. The first four elements may be referred to as 'the primary frame members', since they usually experience the more severe tensile or compressive loads. As will be appreciated by persons skilled in the art, it would be desirable for the elements to meet at a single point defined by the axes along which they lie.

In practice, however, the way in which a connector is designed to receive each of the elements may allow eccentricity in the connection, giving rise to local moments within the space frame. Where the connector is configured to define an almost-entirely non-eccentric connection, the connector is usually very expensive to manufacture, primarily due to high strength requirements: in all concentric connectors, each of the connecting frame elements conveys its full load to the connector base, therefore it must be sufficiently strong to withstand a load which equals at least to that of the most severely stressed frame element.

Made by MERO Tube Construction & Accessories of Wurzburg 4, P.O.B. 462, West Germany is a ball connector having up to nine pairs of holes aligned along up to nine different axes. Each hole is provided with a screw thread and is made so as to receive a structural element, the end of which has a screw configured to be screwably retained by the hole.

A disadvantage of this connector is that two members, for example, lying along a common axis, are not self-locked by means of the connector. Therefore, as movement occurs through the frame, such as may be generated by wind or other conditions of dynamic loading, there is a danger that at least one of the two members will slowly start to unscrew from the connector and that, over a period of time, the member will become completely detached and thereby contribute to failure of the entire structure of which it forms a part. To prevent such danger, relatively high level of periodic maintenance is required. Furthermore, due to the precision machining manufacturing process of the connector, it is generally relatively expensive.

Made by BEN-EZRA KARAGOLA METALWORKS LTD., P.O.B. 805, Industrial Area, Kfar Saba, Israel, is a model B.E.K. connector for space frames. It comprises eight members for receiving tubular structural elements, a first four of which are arranged along two perpendicular axes in a common plane and a second four of which are arranged for partial rotation within two mutually perpendicular planes, each of the second four being arranged so as to receive a diagonal member lying along an axis intersecting with the common plane.

Among disadvantages of the connector to Ben-Ezra is that each of the members is associated with a base member by means of a single bolt shear connection. The holes through which the bolt passes are provided with a relatively high tolerance, for example, a hole of 14 mm diameter is conventionally provided for a 12.7 mm shank diameter bolt so as to ease construction.

As all of the members, including the first four, which would normally experience the more severe loading conditions, are connected by bolts, as outlined above, a large span space frame using the Ben-Ezra connector would, therefore, be liable to sag due to the relative freedom of movement of the bolts within their holes. Such a frame would also be susceptible to high amplitude movement under dynamic loading conditions, such as wind, therefore making the space frame liable to early failure.

Marketed by U. SHLEISSNER LTD., Shiffer St., Petach Tikva, Israel, is a STRUCTIC connector for space frames. The connector defines a support configured to be mounted onto a first primary frame member, made of continuous tubing, at a junction of the member with a similar second primary member and with up to four diagonal members. The support defines a first generally semicircular cutout for mounting onto the first member and a second semicircular cutout for receiving the second member. The first and second tubular primary members are connected to the support by means of field welding during assembly of the structure. The support also includes up to four tongues, generally bisecting the right angles between the primary members and inclined relatively to the planes defined thereby, so as to receive and weldably engage the diagonal members.

Among disadvantages of the Structic connector is that a relatively large eccentricity, approximately equivalent to the diameter of one of these tubular frame members, exists between the first and second primary frame members. This eccentricity leads to the undesirable build-up of relatively large moments within a space frame in which the Structic connector is used.

Furthermore, as the support is attached to the first and second members by on-site welding, thereby preventing application of high quality protective coatings to the welds, they are prone to corrosion. This connector also requires, therefore, a relatively high level of maintenance.

Disclosed in U.S. Pat. No. 3,507,526 to Packman et al is a joint between tubular members lying substantially in a common plane in a tubular steel space structure. The joint is made by means of a pair of clamping elements which are held together by a bolt or bolts and between them define sockets formed with alternating transverse recesses and projections for the reception of the complimentarily shaped ends of the tubular members.

Disclosed in U.S. Pat. No. 4,355,918 to Van Vliet is a connector for elongated frame elements of a structural space frame. The connector consists of three elements which are stacked one on the other along a common axis with the face of each element which abuts that of another including recessed formations which between the opposite element faces define sockets for trapping the headed ends of space frame members. The axes of the sockets between a first pair of element faces lie in a common plane and those between the second pair of faces are inclined relatively to and on the same side of the plane containing the axes of the sockets between the first pair of element faces and apparatus for clamping the elements in the direction of their common axis.

Both the joint to Packman et al and the connector to Van Vliet are characterized by their complex structures and the resulting complicated assembly, resulting in relatively high costs of manufacture when compared with less complex connectors.

The joint to Packman et al is also characterized, in some cases, by welding of members after their insertion between the clamping elements. This welding may cause the connection to be susceptible to corrosion.

The connector to Van Vliet calls for the structural elements being connected to be formed with narrow neck portions at the connection end. The manufacturing process by which the narrow neck portions are formed is, as known in the art, a relatively expensive process.

Further connectors and/or structures employing connectors are disclosed in the U.S. Pat. Nos. 1,771,362, 2,149,844, 4,236,642 and 4,637,748; and in the Israel Patents Nos. 19,782, 29,037 and 69,867.

SUMMARY OF THE INVENTION

It is an aim of the present invention to provide a low-cost space frame connector characterized by providing self locking of coaxial structural members connected thereby, the connector being further characterized by connecting two pairs of members aligned along two nonparallel axes with a relatively small degree of eccentricity therebetween.

There is provided, therefore, in accordance with an embodiment of the invention, a connector for first and second pairs of elongate elements lying along first and second nonparallel axes and having end portions, the connector comprising a base element having at least first and second pairs of threaded portions lying respectively along the first and second axes for engaging end portions of the first and second pairs of elongate elements respectively, the threaded portions of each of the first and second pairs of threaded portions defining parallel screw threads such that adjacent end portions of each of the first and second pairs of elements are respectively threadably engaged by the first and second pairs of threaded portions so as to be tightened in opposite axial directions against the base element.

Additionally in accordance with an embodiment of the invention, the first and second pairs of threaded portions define first and second pairs of outwardly extending threaded elements.

Further in accordance with an embodiment of the invention, the base element defines first and second bores lying along the first and second axes and each of the first and second pairs of outwardly threaded elements is defined by one of first and second elongate connector members housed within one of the first and second bores, the first and second axes being spaced apart by substantially a diameter of a single one of the elongate connector members.

Additionally in accordance with an embodiment of the invention, the base element defines first and second pairs of parallel faces and the first and second bores are provided so as to intersect the first and second pairs of faces at right-angles, the first and second connector members engaging the elongate elements such that their end portions tightly abut the first and second pairs of parallel faces.

Further in accordance with an embodiment of the invention, the first and second axes are arranged in substantially parallel planes and the connector also comprises apparatus for supporting a plurality of diagonal elements lying along axes intersecting at the connector with the substantially parallel planes.

In accordance with an alternative embodiment of the invention, there is provided a structural frame including first and second pairs of elongate elements lying along first and second nonparallel axes and having end portions; and apparatus for connecting comprising a base element having at least first and second pairs of threaded portions lying respectively along the first and second axes for engaging end portions of the first and second pairs of elongate elements respectively, the threaded portions of each of the first and second pairs of threaded portions defining parallel screw threads such that adjacent end portions of each of the first and second pairs of elements are respectively threadably engaged by the first and second pairs of threaded portions so as to be tightened in opposite axial directions against the base element.

Additionally in accordance with an embodiment of the invention, the first and second pairs of threaded portions define first and second pairs of outwardly extending threaded elements.

Further in accordance with an embodiment of the invention, the end portions of the first and second pairs of elongate elements define axial bores for receiving therein one of the outwardly extending threaded elements.

BRIEF DESCRIPTION OF THE DRAWINGS

The present invention will be understood and appreciated more fully from the following detailed description, taken in conjunction with the drawings, in which.

DETAILED DESCRIPTION OF THE INVENTION

Figure 1A:
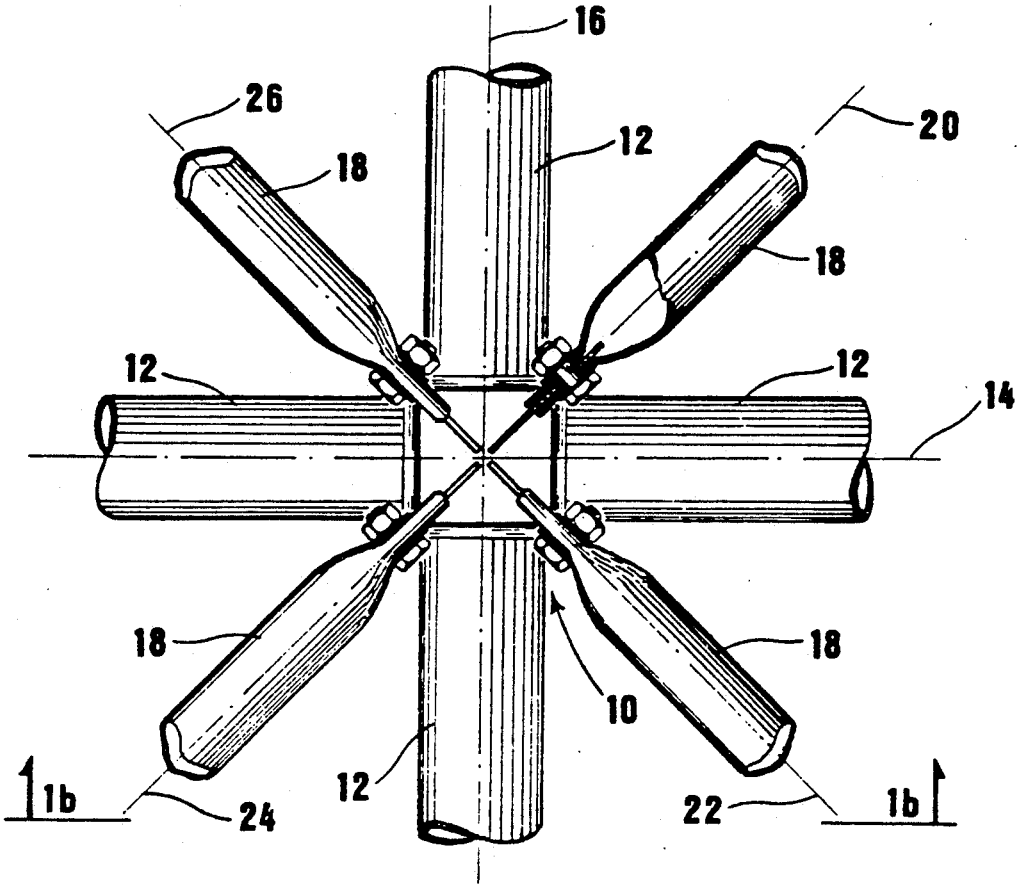
FIG. 1A is a plan view illustration of a connection forming a portion of a structural frame employing a connector constructed in accordance with a preferred embodiment of the invention.
Figure 1B:
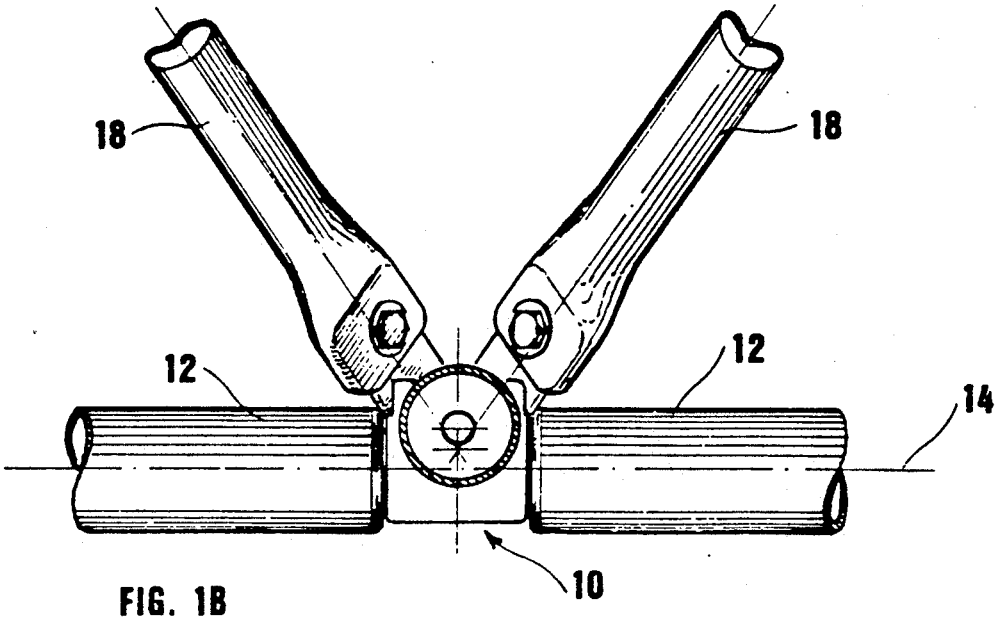
FIG. 1B is a side view illustration of the connection of FIG. 1A, taken along line **1*b*—1*b*** therein.

Reference is made to FIGS. 1A and 1B in which are shown plan and side views of a connection in a structural frame, such as a space frame employing a connector 10, constructed in accordance with a preferred embodiment of the present invention. Connector 10 is provided to connect two pairs of 'primary' structural elements, referenced 12, each pair being aligned typically along mutually perpendicular axes 14 and 16.

It will be appreciated that although connector 10 is described herein as being used in a space frame, it is intended to be used also in the context of other types of structural frame, for example, a plane frame.

It is a feature of the present invention that each pair of elements is connected with the maximum degree of continuity, so that the transmission of forces between them is as direct as possible, and that the eccentricity between each pair of elements at the connection is kept to a minimum. A further feature is that both elements 12 in each pair of elements are 'self-locking' such that any movement in a structure of which elements 12 form a part which conventionally would cause loosening of a connection, would not effect, in the present invention, the tightness of the connection. This will be appreciated from the ensuing description.

Connector 10 also serves to connect 'secondary' diagonal elements 18 aligned along axes 20, 22, 24 and 26, to primary elements 12. This would typically occur in a space frame construction, wherein two or more horizontal layers of primary support elements, such as elements 12, are connected by an intervening layer of diagonal elements. According to the shown embodiment, secondary elements 18 are arranged to bisect the angles formed between axes 14 and 16, as viewed from above (FIG. 1A) although any other preferred arrangement may also be adopted.

Figure 2A:
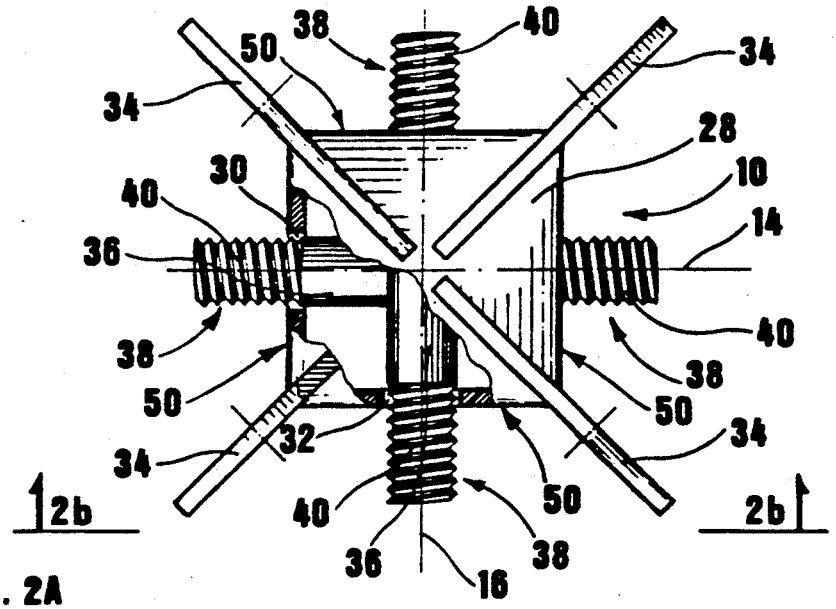
FIG. 2A is an enlarged plan view illustration of the connector shown in FIGS. 1A and 1B.
Figure 2B:
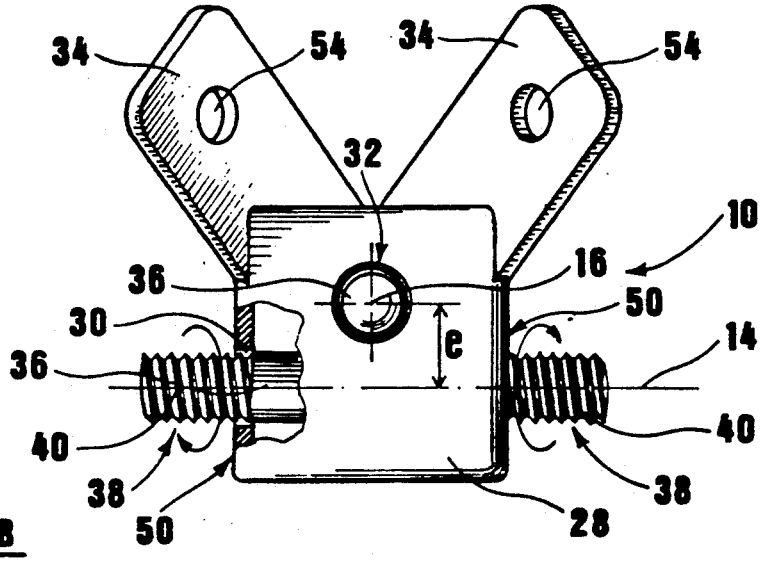
FIG. 2B is a side view illustration of the connector of FIG. 2A, taken along line **2*b*—2*b*** therein.

Referring now to FIGS. 2A and 2B, it is seen that connector 10 comprises a base 28, which is solid and made typically of steel or which alternatively is hollow and is formed typically from steel plates welded together. Base 28 defines first and second bores, respectively referenced 30 and 32. Bores 30 and 32, when connector 10 is in use, lie along respective axes 14 and 16. Base 28 also includes a plurality of flanges 34, for receiving secondary elements 18. Flanges 34 may be attached to base 28 as by welding.

Figure 3:
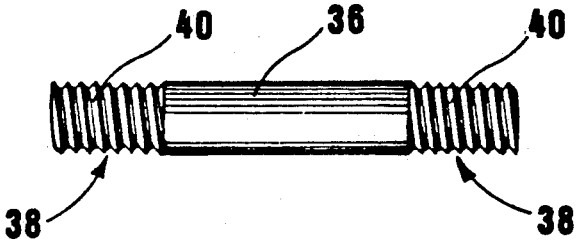
FIG. 3 is an illustration of an elongate connector member as shown in FIGS. 2A and 2B.

Referring also to FIG. 3, base 28 includes a pair of elongate connector members 36, removably housed within bores 30 and 32. The diameters of bores 30 and 32 and connector members 36 are such that connector members 36 may, on assembly, be inserted into the bores but with the minimum of 'play' between them. Although bores 30 and 32 typically have the same diameter, this need not always be so. When housed within bores 30 and 32, ends 38 of connector members 36 protrude outwardly from the bores.

Figure 4:
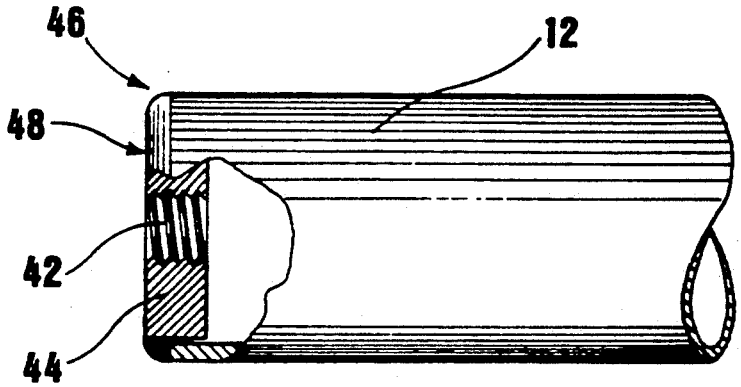
FIG. 4 shows an end portion of a primary support element, modified for engagement with the connector shown in FIGS. 2A and 2B.

Referring additionally to FIG. 4, ends 38 define screw threads 40 which are compatible with a screw thread 42 provided in an end member 44, mounted in an end 46 of a primary element 12.

The threads 40 formed at either end 38 of members 36 are formed in parallel directions such that as a pair of coaxially arranged primary elements 12 are screwed in the directions indicated in FIG. 2B, onto a member 36 inserted, for example, into bore 30, elements 12 become engaged with connector 10, until faces 48 of end members 44 tightly abut an adjacent face 50 of base 28. End members 44 may be fixed to element 12 by any conventional method, such as by welding. Two adjacent coaxial elements 12 usually experience loads of similar type and magnitude and, as known in the art, such loads must be transmitted from one element to the other through the connector. It will be appreciated that when the aforesaid loads are tensile forces, elongate connector member 36 alone transmits the load from one element 12 to the other, so that connector base 28 remains unstressed. Hence the present invention considerably alleviates the required tensile strength of connector base 28, compared to concentric connectors, where the connector base would be fully stressed when transmitting such tensile forces.

With further reference to FIG. 2B, it will be appreciated that when two pairs of elements 12 are connected by connector 10 of the invention, there exists a slight eccentricity 'e'. This eccentricity is, however, equivalent to substantially a single diameter of a connecting member 36 and is, therefore, considerably less significant than other 'eccentric' connectors wherein the eccentricity may be several times larger than this. In Structic connector, for example, the eccentricity equals at least to the diameter of a primary frame element 12, which is on the order of four times 'e', thereby building-up considerably larger local moments, and giving rise to earlier buckling of the most severely compressed primary frame elements.

It will be appreciated that as elements 12 tighten against not only faces 50 of base 28 but also against each other, any slight movement of elongate connector member 36 that might tend, in a conventional bolted connection, to loosen one of primary elements 12, would immediately be compensated for by tightening of its coaxially adjacent element 12. The possible range of rotary motion for connector member 36, in the assembled connection, is very limited, due to the central unthreaded portion. Hence, in the completed structure, primary elements 12 are locked in position, uncapable to move and uneffected by the loosening tendency of vibration, such as may be caused by dynamic loading conditions. This self locking feature offers a higher degree of safety, and alternatively lower maintenance costs compared to other types of bolted connections, as no periodic bolt retightening is required.

Figure 5:
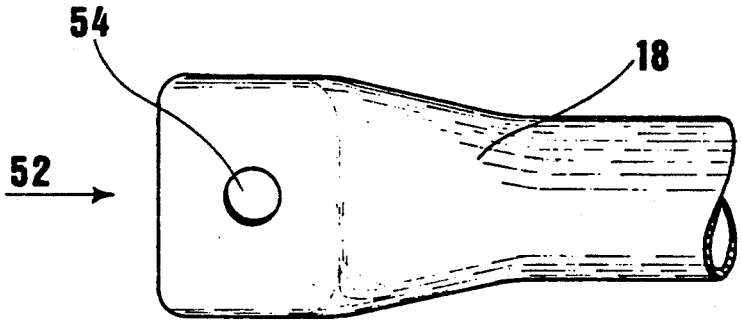
FIG. 5 shows an end portion of a secondary support element, modified for engagement with the connector shown in FIGS. 2A and 2B.

Referring now also to FIG. 5, there is shown a modified end portion of a secondary element 18. The end portion of element 18 is, according to the shown embodiment, flattened so as to define a rectangular aperture (not shown) when viewed end on, as indicated by arrow 52. Holes 54 are provided, both in flanges 34 and the flattened end of element 18. Once an element 18 has been inserted over a flange 34, a fastener (shown in FIG. 1A), as known in the art, may be passed through so as to secure the element to the flange.

In accordance with a preferred embodiment of the invention, as no on-site welding is required, the present invention facilitates the application of high quality corrosion-resistant coatings to the connector 10 and to the elements 12 and 18 as known in the art, for example, hot dipping.

It will be appreciated that assembly of a framed structure employing the connector 10 of the present invention together with suitably modified end portions of primary elements 12 (as shown in FIG. 4), requires axial rotation of one primary structural element 12 relative to an adjacent element 12, until both adjacent coaxial elements 12 have been tightened against the connector.

There are, however, instances wherein it may be difficult to effect relative rotation of a primary element 12, an example of which is when the element is to be installed in between two assembled parts of a space frame. Accordingly, the end portion of element 12 is modified as shown in FIG. 6 thereby overcoming this problem.

Figure 6:
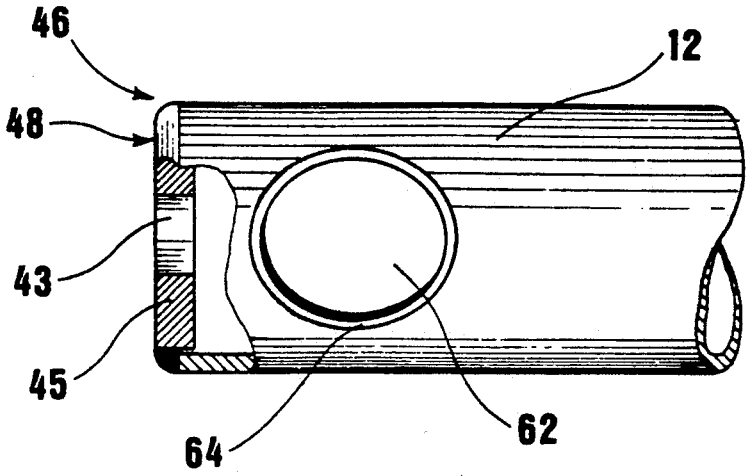
FIG. 6 shows an end portion of a primary support element, modified for engagement with the connector shown in FIGS. 2A and 2B and constructed according to an alternative embodiment.

The embodiment shown in FIG. 6 comprises an element 12 which includes an end member 45, which is similar to end member 44 (FIG. 4) but which defines a smooth bore 43 having substantially the same diameter as an adjacent bore 30 or 32 of base 28 (FIGS. 2A and 2B).

In assembly, smooth bore 43 is inserted over an end portion 38 of member 36 and, via an opening 62 provided in element 12, a nut (not shown) may be used to secure it to connector 10. Opening 62 is sufficiently large to permit tightening by means of a wrench or a similar tool and the opening is provided with an edge reinforcement 64, as known in the art, to compensate for the weakening of the element 12 by provision of the opening.

It will be appreciated by persons skilled in the art that the present invention is not limited by what has been specifically shown and described above. The invention is limited, rather, solely by the claims, which follows:

I claim:

1. A connector for first and second pairs of elongate elements lying along first and second nonparallel axes and having end portions, said connector comprising:

a base element having at least first and second pairs of outwardly extending threaded members lying respectively along the first and second nonparallel axes for engaging said end portions of said first and second pairs of elongate elements respectively, each of said first and second pairs of outwardly extending threaded members having threaded portions defining parallel screw threads such that adjacent end portions of each of the first and second pairs of elongate elements are respectively threadedly engaged by said first and second pairs of threaded members so as to be tightened in opposite axial directions against said base element, said base element defining first and second bores lying along said first and second axes and each of said first and second pairs of outwardly extending threaded members being defined by one of first and second elongate connector members housed within one of said first and second bores, said first and second axes being spaced apart by substantially a diameter of a single one of said elongate connector members.

2. A connector according to claim 1, and wherein said base defines first and second pairs of parallel faces and said first and second bores are provided so as to intersect said first and second pairs of faces at right-angles, said first and second elongate connector members engaging the elongate elements such that respective end portions of said elongate connector member tightly abut a respective first and second pairs of parallel faces.

3. A connector according to claim 2, and wherein said first and second pairs of parallel faces are defined at rightangles to each other.

4. A connector according to claim 3, and wherein said first and second axes define substantially parallel planes and said connector further comprises means for supporting a plurality of diagonal elements lying along axes intersecting at said connector with the substantially parallel planes.

5. A connector according to claim 4, and wherein said means for supporting a plurality of diagonal elements comprises first and second means for supporting respective first and second pairs of diagonal elements arranged in respective first and second intersecting planes oriented at right-angles to the substantially parallel planes.

6. A connector according to claim 5, and wherein said first and second axes substantially bisect angles defined between said first and second intersecting planes.

7. A connector according to claim 6, and wherein said first and second means for supporting comprises:

first and second pairs of protrusions mounted onto said base for engaging the first and second pairs of diagonal elements; and means for fastening the first and second pairs of diagonal elements to said first and second pairs of protrusions.

8. A structural frame comprising:

at least first and second pairs of elongate elements lying along first and second nonparallel axes and having end portions; and means for connecting said elongate elements comprising:

a base element having at least first and second pairs of outwardly extending threaded members lying respectively along said first and second axes for engaging said end portions of said first and second pairs of elongate elements respectively, each of said first and second pairs of outwardly extending threaded members having threaded portions defining parallel screw threads such that adjacent end portions of each of said first and second pairs of elongate elements are respectively threadably engaged by said first and second pairs of threaded portions so as to be tightened in opposite axial directions against said base element, said base element defining first and second bores lying along said first and second axes and each of said first and second pairs of outwardly extending threaded members being defined by one of first and second elongate connector members housed within one of said first and second bores, said first and second axes being spaced apart by substantially a diameter of a single one of said elongate connector members.

9. A structural frame according to claim 8, and wherein said end portions of said first and second pairs of elongate elements define axial bores for receiving therein one of said outwardly extending threaded members.

10. A structural frame according to claim 9, and wherein each of said axial bores defines screw threads for threadedly receiving therein one of said outwardly extending threaded members.

11. A structural frame according to claim 10, and wherein said base defines first and second pairs of parallel faces and said first and second bores are provided so as to intersect said first and second pairs of faces at right-angles, said first and second connector members engaging said elongate elements such that their end portions tightly abut said first and second pairs of parallel faces.

12. A structural frame according to claim 11, and wherein said first and second pairs of parallel faces are defined at right-angles to each other.

13. A structural frame according to claim 12, and wherein said first and second axes define substantially parallel planes and said structural frame also comprises a plurality of diagonal elements lying along axes intersecting at said means for connecting with said substantially parallel planes, said means for connecting also comprising means for supporting said plurality of diagonal elements.

14. A structural frame according to claim 13, and wherein said plurality of diagonal elements comprises first and second pairs of diagonal elements arranged in respective first and second intersecting planes oriented at right-angles to said substantially parallel planes.

15. A structural frame according to claim 14, and wherein said first and second axes substantially bisect angles defined between said first and second intersecting planes.

16. A structural frame according to claim 15, and wherein said means for supporting said diagonal elements comprises:

first and second pairs of protrusions mounted onto said base for engaging said first and second pairs of diagonal elements; and means for fastening said first and second pairs of diagonal elements to said first and second pairs of protrusions.

* * * * *